US010494206B2

(12) United States Patent
Furumoto et al.

(10) Patent No.: US 10,494,206 B2
(45) Date of Patent: Dec. 3, 2019

(54) SHEET ACCOMMODATING DEVICE AND IMAGE FORMING APPARATUS INCLUDING THE SAME

(71) Applicant: SHARP KABUSHIKI KAISHA, Sakai, Osaka (JP)

(72) Inventors: Haruhisa Furumoto, Sakai (JP); Kohji Aoki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/177,437

(22) Filed: Nov. 1, 2018

(65) Prior Publication Data

US 2019/0127160 A1 May 2, 2019

(30) Foreign Application Priority Data

Nov. 1, 2017 (JP) ..... 2017-212001

(51) Int. Cl.

| | |
|---|---|
| ***B65H 1/12*** | (2006.01) |
| ***B65H 1/04*** | (2006.01) |
| ***B65H 1/26*** | (2006.01) |
| ***G03G 15/00*** | (2006.01) |

(52) U.S. Cl.

CPC ..... *B65H 1/12* (2013.01); *B65H 1/04* (2013.01); *B65H 1/266* (2013.01); *G03G 15/6502* (2013.01); *B65H 2401/115* (2013.01); *B65H 2401/15* (2013.01); *B65H 2405/1117* (2013.01); *B65H 2511/12* (2013.01); *B65H 2801/06* (2013.01)

(58) Field of Classification Search

CPC .. B65H 2404/1117; B65H 1/12; B65H 1/266; B65H 1/04

See application file for complete search history.

(56) References Cited

U.S. PATENT DOCUMENTS

| | | | | |
|---|---|---|---|---|
| 5,199,695 | A * | 4/1993 | Nakahata | B65H 1/12 271/127 |
| 5,419,543 | A * | 5/1995 | Nakamura | B41J 13/10 271/9.01 |
| 6,039,315 | A * | 3/2000 | Lim | B65H 1/12 271/160 |
| 2019/0002218 | A1* | 1/2019 | Shimura | B65H 1/08 |

FOREIGN PATENT DOCUMENTS

JP 2001-063836 A 3/2001

* cited by examiner

*Primary Examiner* — Patrick Cicchino
(74) *Attorney, Agent, or Firm* — ScienBiziP, P.C.

(57) ABSTRACT

A sheet accommodating device includes a first plate member on which sheets are mounted, a first biasing member that presses up the first plate member, a second plate member disposed on a side of the first plate member opposite to a side of the first plate member on which the sheets are mounted; and a second biasing member that presses up the second plate member, and has a configuration in which, according to a size of the sheets, the first biasing member presses up the first plate member or both the first and second biasing members press up both the first and second plate members. An area of the first plate member is smaller than an area of the second plate member.

6 Claims, 17 Drawing Sheets

SHEET ACCOMMODATING DEVICE AND IMAGE FORMING APPARATUS INCLUDING THE SAME

BACKGROUND

1. Field

The present disclosure relates to a sheet accommodating device and an image forming apparatus, such as a copier, an MFP, a printer, or a facsimile apparatus, including the same.

2. Description of the Related Art

In general, an image forming apparatus includes a sheet accommodating device (or more specifically, a paper feed cassette or a paper feed tray) that accommodates sheets such as recording paper, and in performing an image forming operation, the sheets accommodated in the sheet accommodating device are fed one by one from the sheet accommodating device to an image forming apparatus body by a sheet feeding member (or more specifically, a pickup roller) for image formation in the image forming apparatus body.

Some sheet accommodating device includes a plate member on which sheets are loaded and that turns around an axis extending along a width direction orthogonal to a sheet feed direction and a biasing member that presses up the plate member toward the sheet feeding member. In such a sheet accommodating device, the pressing force of the biasing member against the sheet feeding member becomes smaller as the size of the sheets becomes larger (i.e. as the weight of the sheets becomes heavier), and to that extent, empty feeding is likely to occur. On the other hand, the pressing force of the biasing member against the sheet feeding member becomes larger as the size of the sheets becomes smaller (i.e. as the weight of the sheets becomes lighter), and to that extent, multiple feeding is likely to occur.

In this regard, Japanese Unexamined Patent Application Publication. No. 2001-63836 discloses a sheet accommodating device including a first plate member on which sheets are mounted, a first biasing member that presses up the first plate member, a second plate member disposed on a side of the first date member opposite to a side of the first plate member on which the sheets are mounted, and a second biasing member that presses up the second plate member, wherein the biasing member presses up the first plate member or both the first and second biasing members press up both the first and second plate members. The sheet accommodating device prevents the occurrence of empty feeding or multiple feeding regardless of the size of the sheets by properly adjusting the pressing force of the sheets against the sheet feeding member by changing, according to the size of the sheets, the upward pressing force acting on the first plate member.

However, in the configuration described in Japanese Unexamined Patent Application Publication No. 2001-63836, an area of the first plate member is larger than an area of the second plate member. For this reason, the first plate member is normally heavier than the second plate member, and it is necessary to use, as the first biasing member, which presses up the first plate member, a biasing member that has a great upward pressing force accordingly. In general, the biasing member, which presses up the first plate member, becomes greater in tolerance as it becomes greater in upward pressing force. This causes deterioration in pressure accuracy of the pressing force of the sheets against the sheet feeding member.

It is desirable to provide a sheet accommodating device and an image forming apparatus that make it possible to improve pressure accuracy of the pressing force of the sheets against the sheet feeding member.

SUMMARY

According to an aspect of the disclosure, there is provided a sheet accommodating device including: a first plate member on which sheet are mounted; a first biasing member that presses up the first plate member; a second plate member disposed on a side of the first plate member opposite to a side of the first plate member on which the sheets are mounted; and a second biasing member that presses up the second plate member, the sheet accommodating device having a configuration in which, according to a size of the sheets, the first biasing member presses up the first plate member or both the first and second biasing members press up both the first and second plate members, wherein an area of the first plate member is smaller than an area of the second plate member. Further, according to an aspect of the disclosure, there is provided an image forming apparatus including the sheet accommodating device according to the foregoing aspect of the present disclosure.

DESCRIPTION OF THE EMBODIMENTS

An embodiment of the present disclosure is described below with reference to the drawings.

Overall Configuration of Image Forming Apparatus

Figure 1:
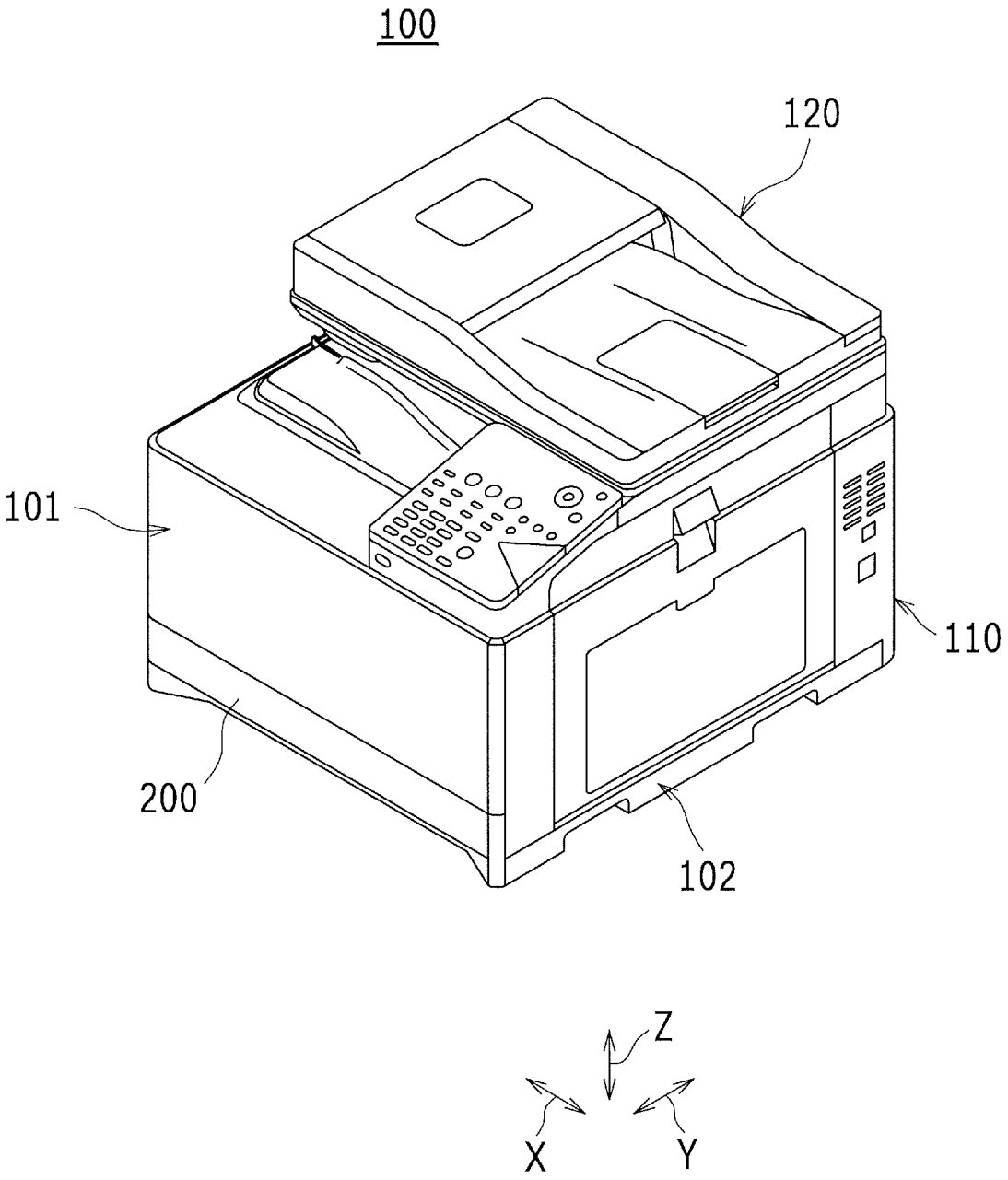
FIG. 1 is a perspective view showing an appearance of an image forming apparatus according to the present embodiment.

FIG. 1 is a perspective view showing an appearance of an image forming apparatus 100 according to the present embodiment. In FIG. 1, the sings X, Y, and Z denote a horizontal direction, a depth direction, and a vertical direction, respectively, of the image forming apparatus 100.

The image forming apparatus 100 shown in FIG. 1 is an image forming apparatus, including an image carrier (or more specifically, a photosensitive drum; not illustrated), that forms an image on a sheet (or more specifically, a recording sheet) such as recording paper (not illustrated) in accordance with image data transmitted from an outside source. The imaging forming apparatus 100 may be a monochrome image forming apparatus or a color image forming apparatus (e.g. a tandem color image forming apparatus).

The image forming apparatus 100 includes an image forming apparatus body 110 and an image reading device 120. The image forming apparatus body 110 is provided with an image forming unit 101 and a sheet conveyance system 102.

The image forming apparatus 100 includes a sheet accommodating device 200 (or more specifically, a paper feed cassette or a paper feed tray) that accommodates sheets. The image forming apparatus 100 is configured such that in performing an image forming operation, the sheets accommodated in the sheet accommodating device 200 are fed one by one from the sheet accommodating device 200 to the image forming apparatus body 110 by a sheet feeding member (or more specifically, a pickup roller 271; not illustrated in FIG. 1; see FIGS. 2 and 17 described below) for image formation in the image forming apparatus body 110.

Sheet Accommodating Device

Figure 2:
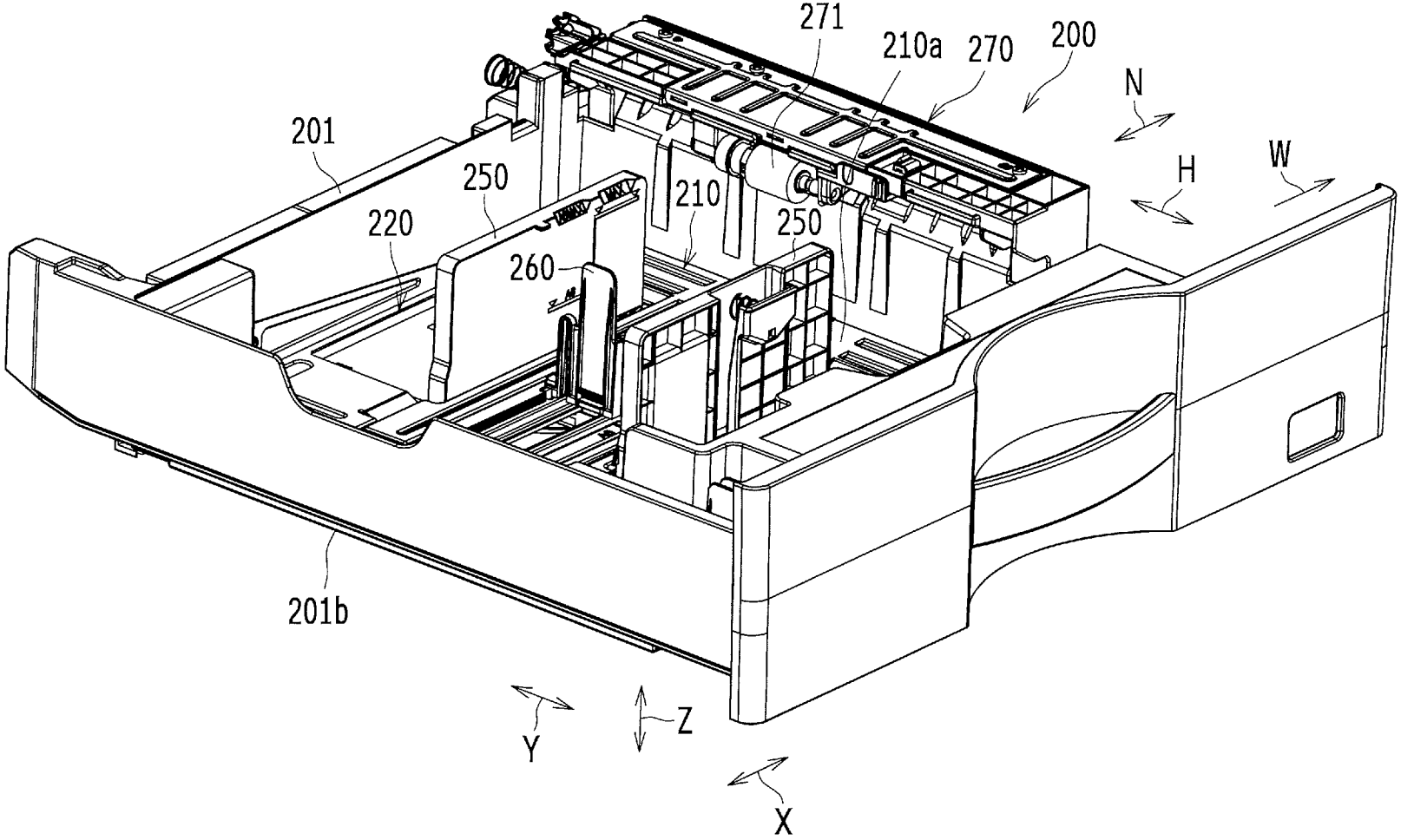
FIG. 2 is a schematic perspective view showing, from obliquely above the front, a state where both a first plate member and a second plate member are located in the lowest position in a sheet accommodating device according to the present embodiment.
Figure 3:
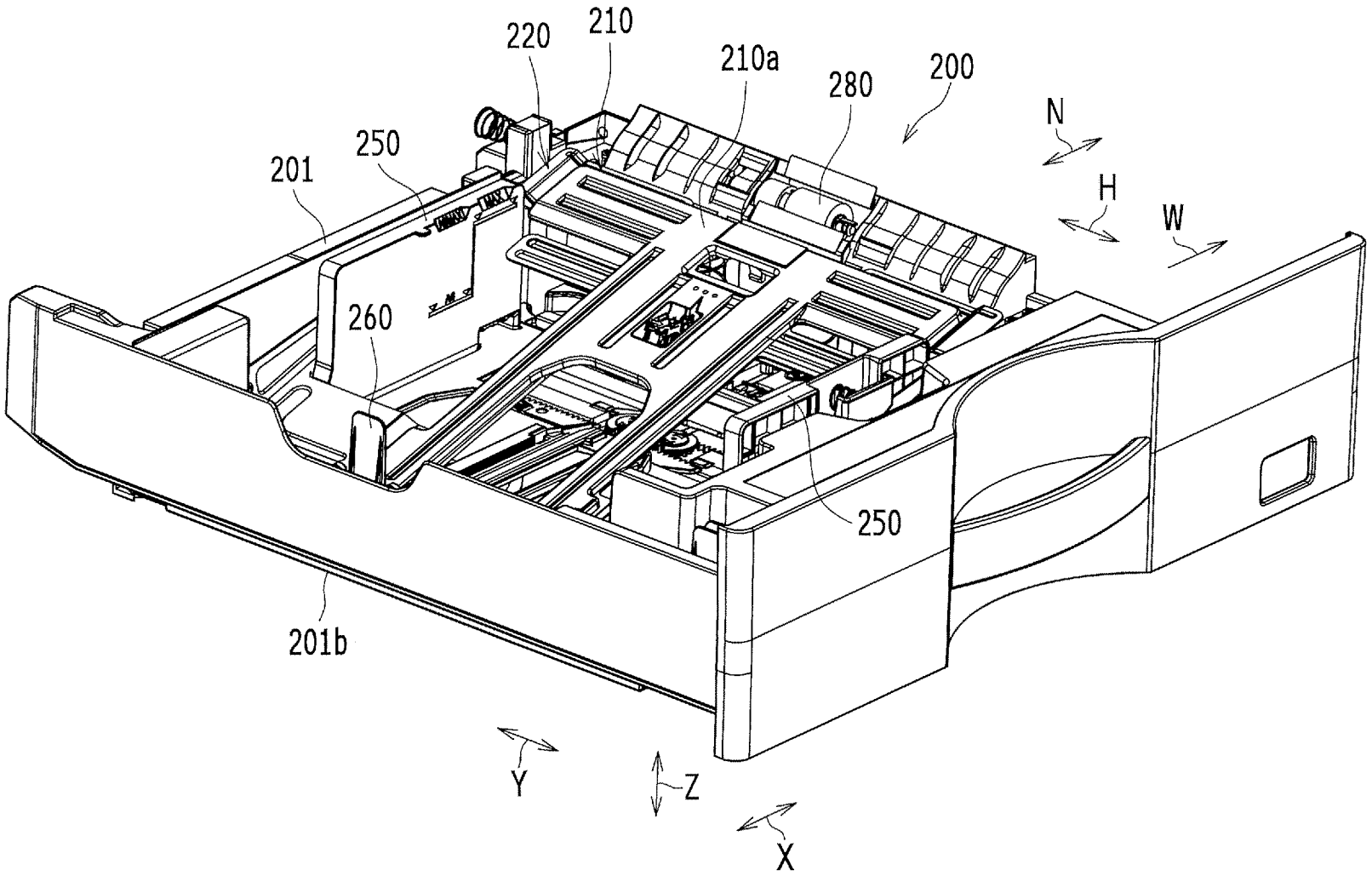
FIG. 3 is a schematic perspective view showing, from obliquely above the front, a state where both the first and second plate members are located in the highest position in the sheet accommodating device according to the present embodiment with a sheet feeding device removed therefrom.
Figure 4:
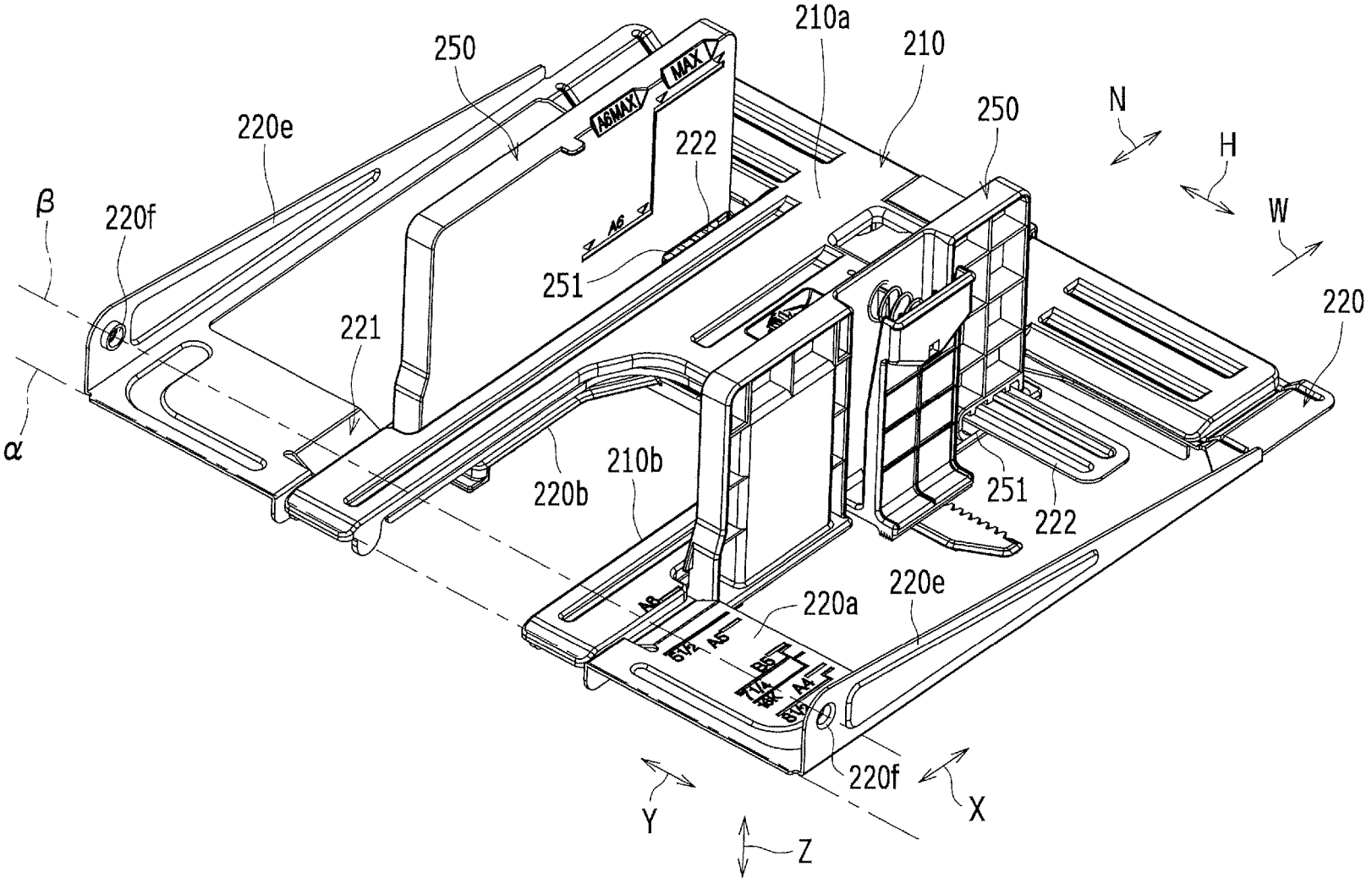
FIG. 4 is a schematic perspective view showing a state where both the first and second plate members are located in the lowest position in the sheet accommodating device according to the present embodiment.
Figure 5:
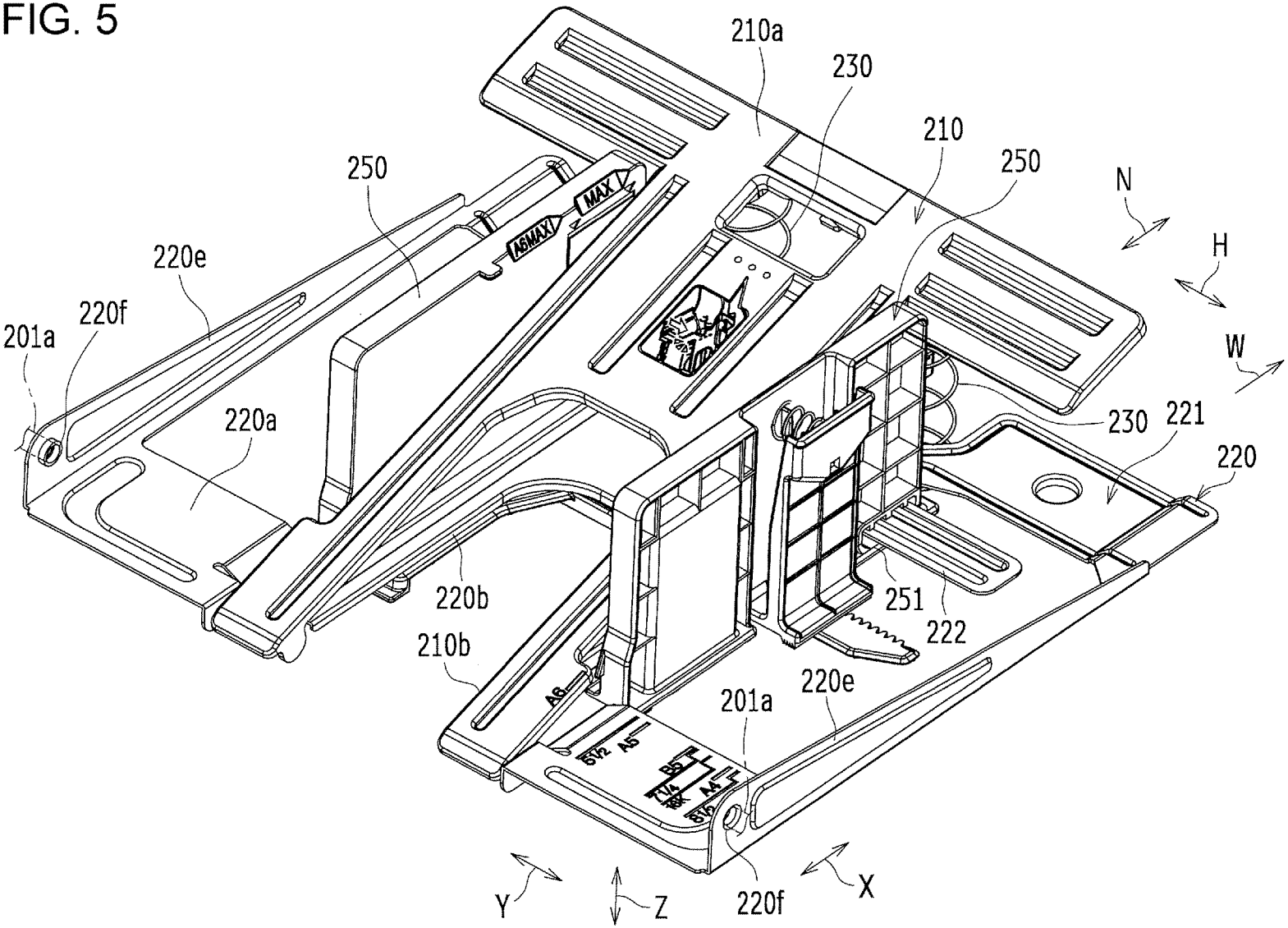
FIG. 5 is a schematic perspective view showing a state where the first plate member is located in the highest position by a first upward pressing action in the sheet accommodating device according to the present embodiment.
Figure 6:
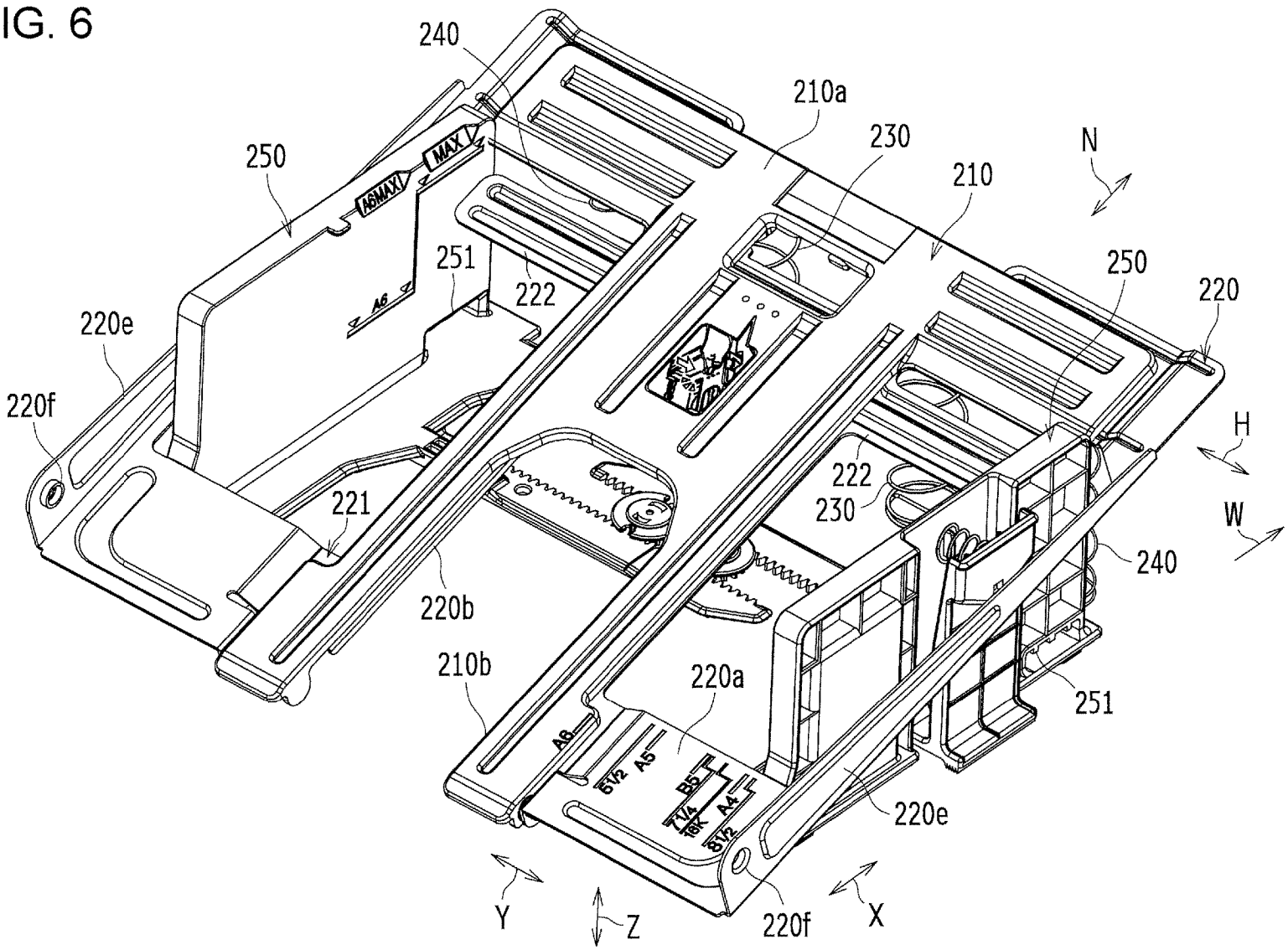
FIG. 6 is a schematic perspective view showing a state where both the first and second plate members are located in the highest position by a second upward pressing action in the sheet accommodating device according to the present embodiment.
Figure 7:
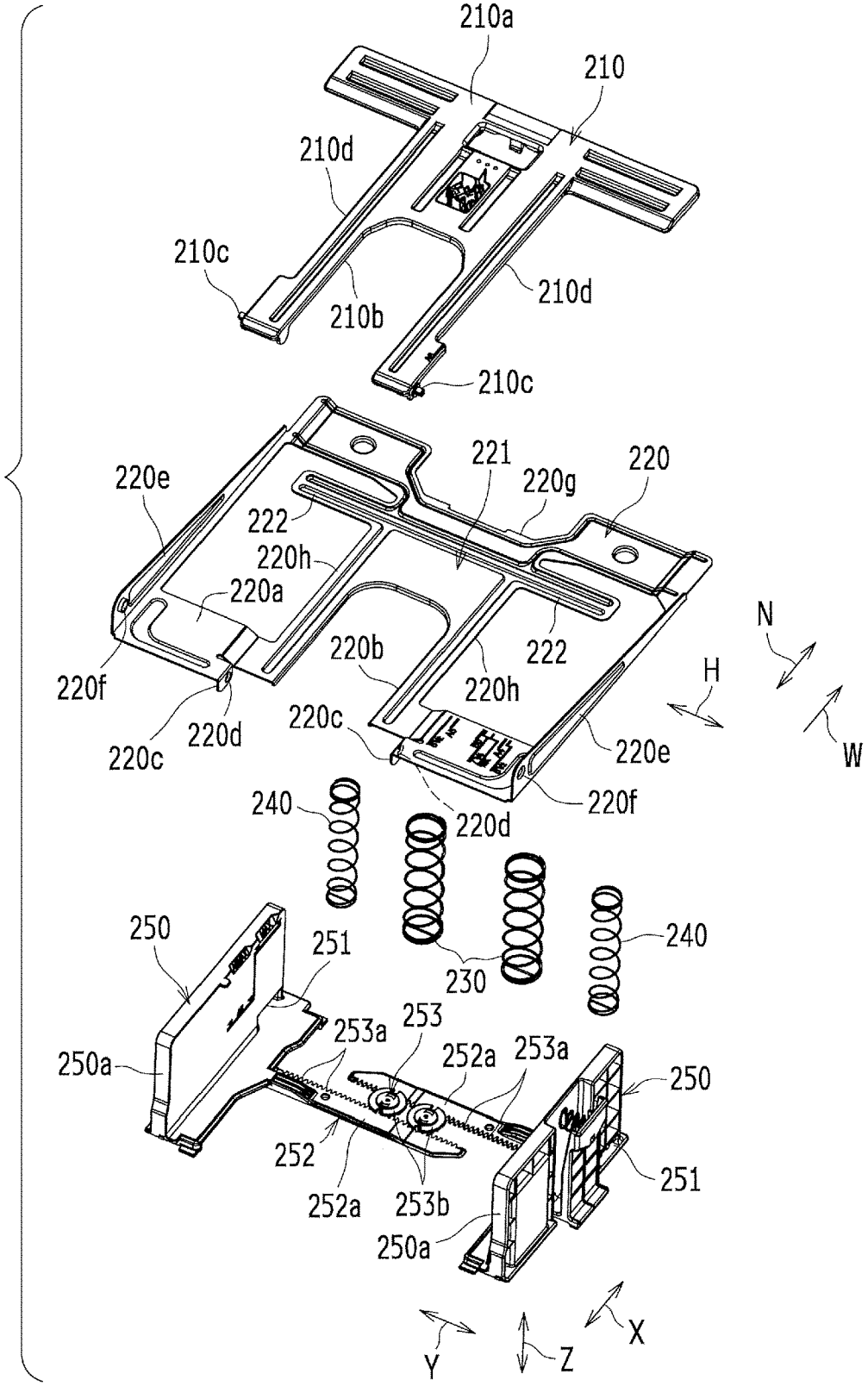
FIG. 7 is an exploded perspective view of the first plate member, the second plate member, a first biasing member, a second biasing member, and a width regulating member in the sheet accommodating device according to the present embodiment.
Figure 8:
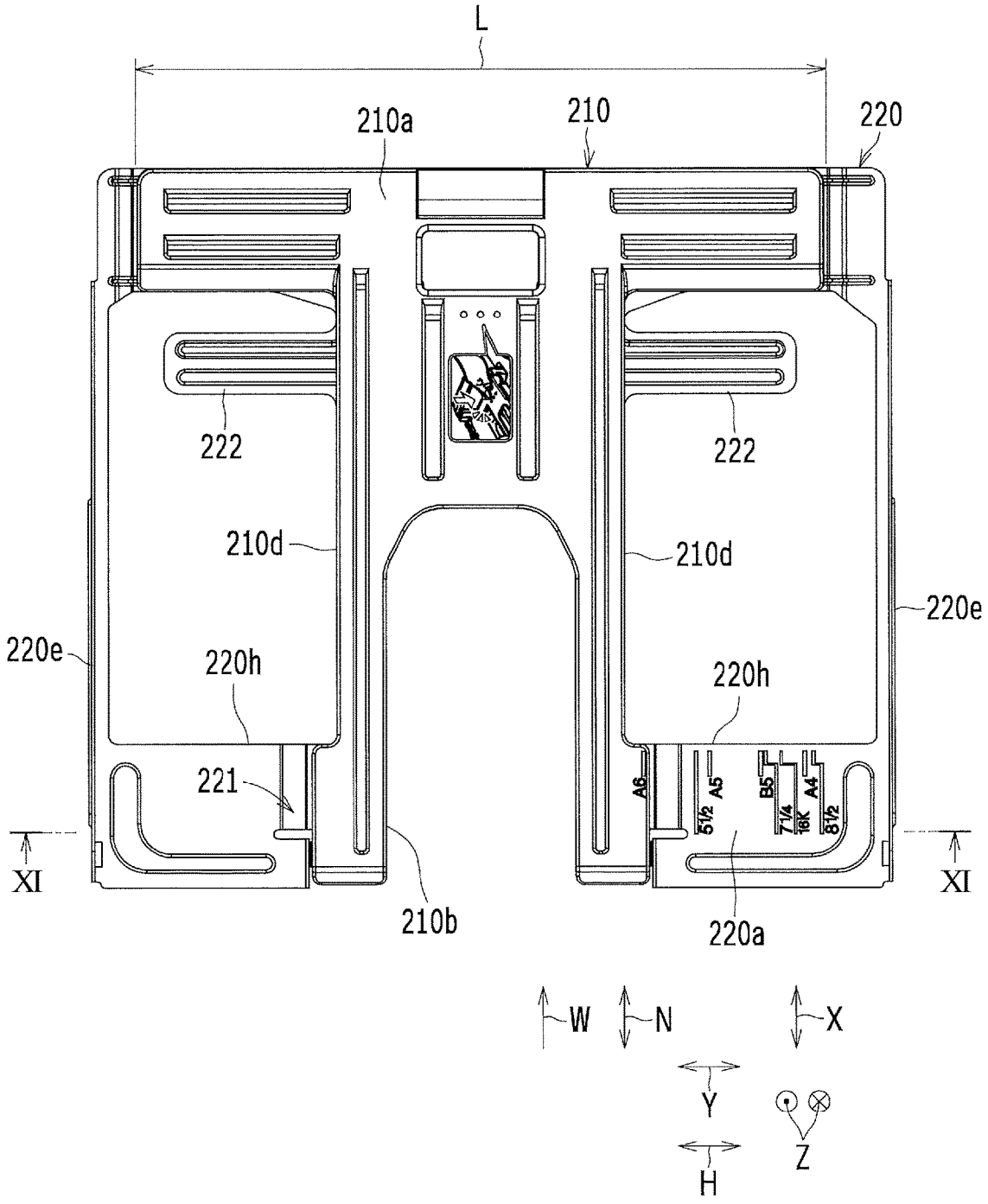
FIG. 8 is a schematic plan view showing examples of the first and second plate members.
Figure 9:
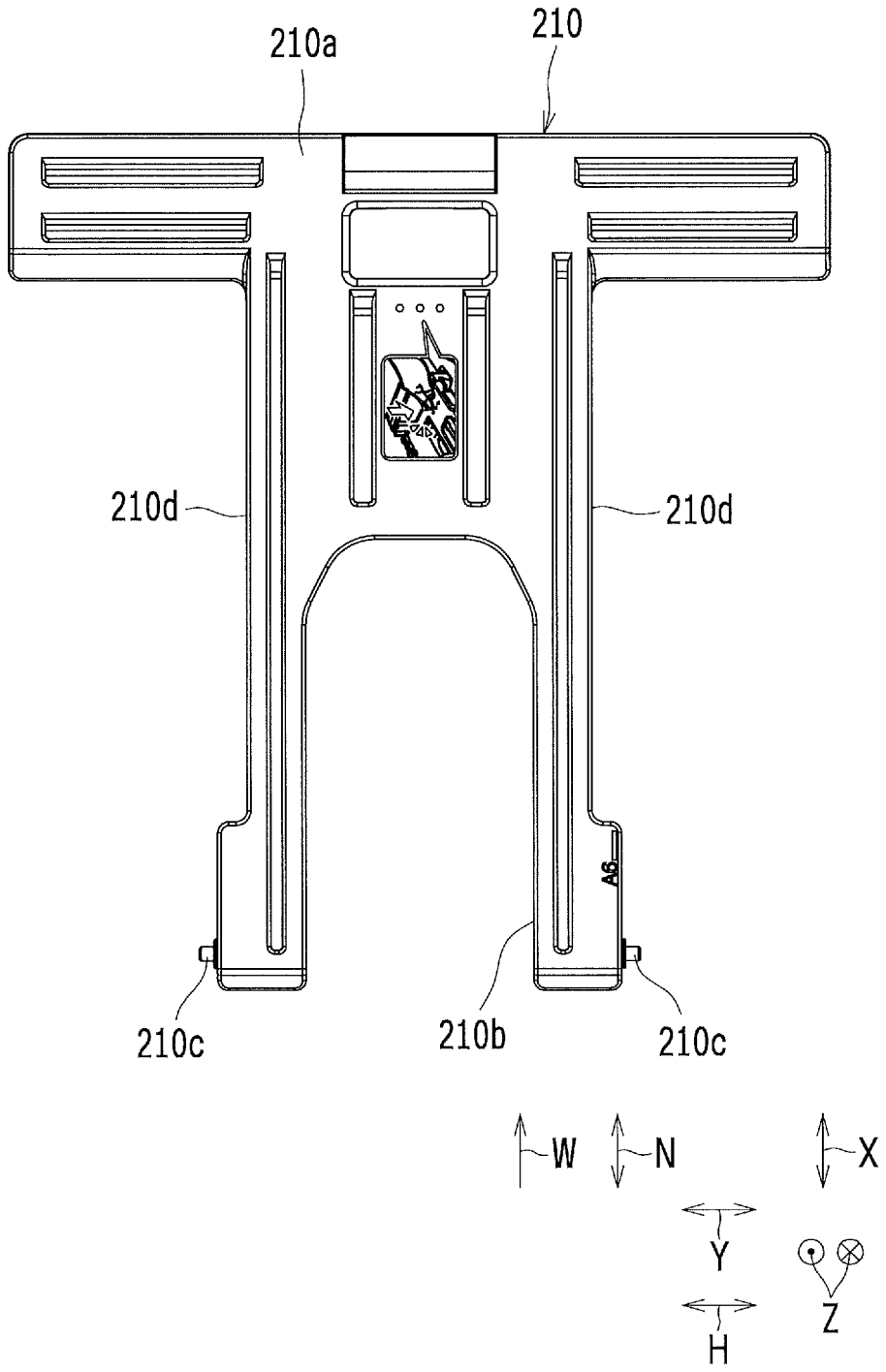
FIG. 9 is a schematic plan view showing the first plate member.
Figure 10:
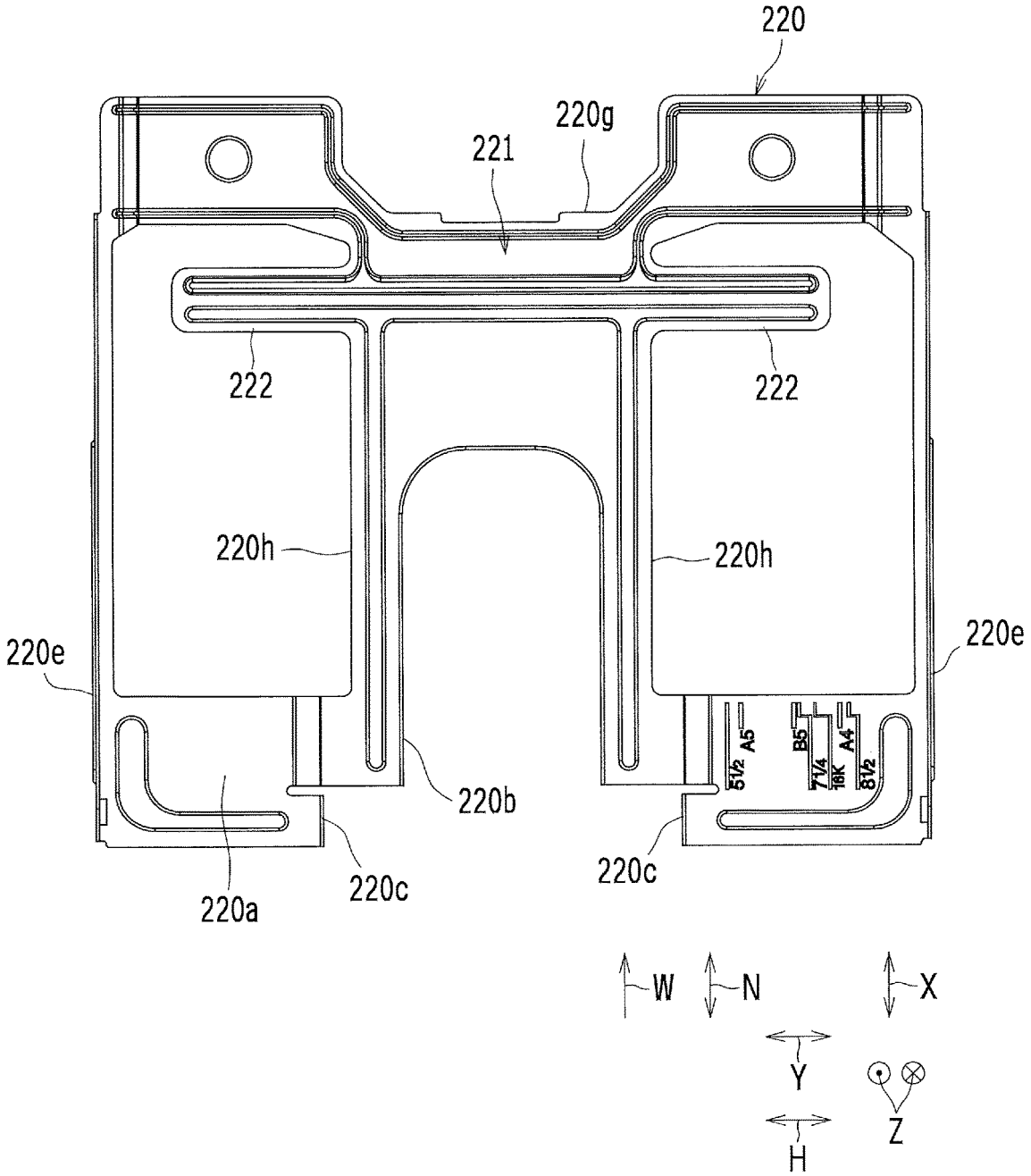
FIG. 10 is a schematic plan view showing the second plate member.
Figure 11:
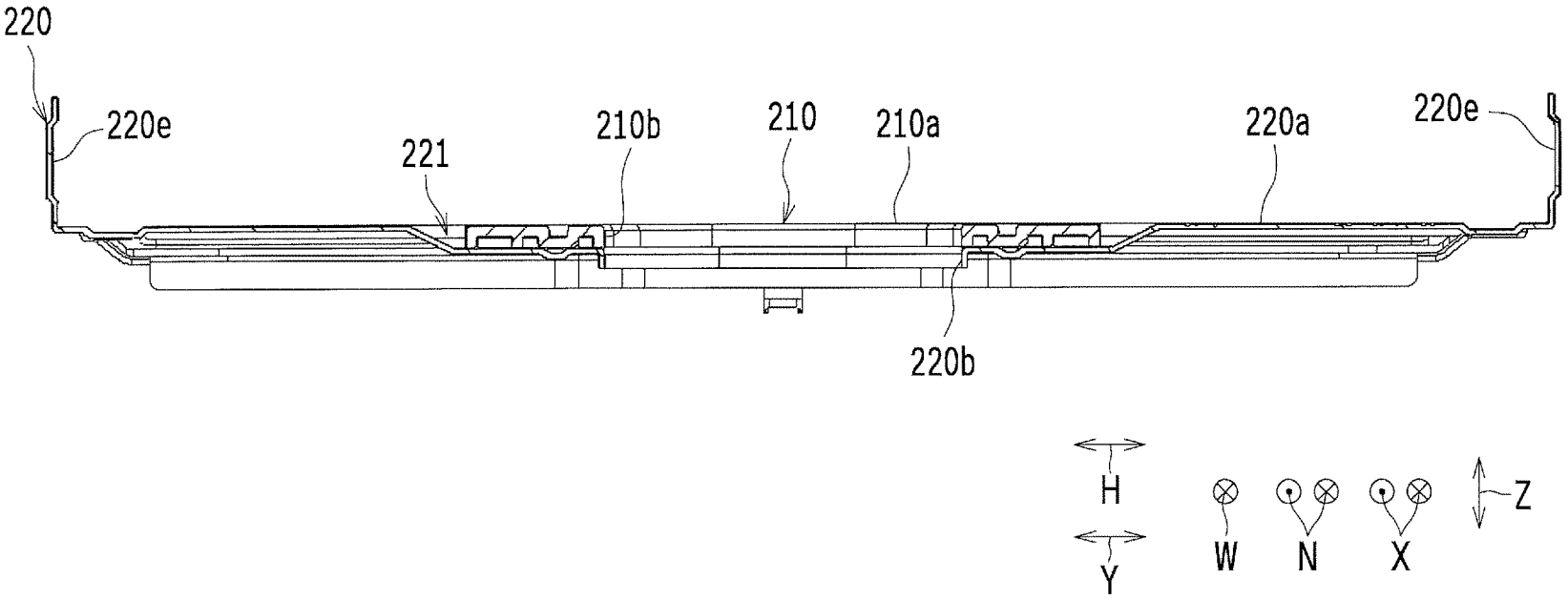
FIG. 11 is a schematic cross-sectional view taken along line XI-XI shown in FIG. 6.

FIG. 2 is a schematic perspective view showing, from obliquely above the front, a state where both a first plate member 210 and a second plate member 220 are located in the lowest position in the sheet accommodating device 200 according to the present embodiment. FIG. 3 is a schematic perspective view showing, from obliquely above the front, a state where both the first and second plate members 210 and 220 are located in the highest position in the sheet accommodating device 200 according to the present embodiment with a sheet feeding device 270 removed therefrom. FIG. 4 is a schematic perspective view showing a state where both the first and second plate members 210 and 220 are located in the lowest position in the sheet accommodating device 200 according to the present embodiment. FIG. 5 is a schematic perspective view showing a state where the first plate member 210 is located in the highest position by a first upward pressing action in the sheet accommodating device 200 according to the present embodiment. FIG. 6 is a schematic perspective view showing a state where both the first and second plate members 210 and 220 are located in the highest position by a second upward pressing action in the sheet accommodating device 200 according to the present embodiment. FIG. 7 is an exploded perspective view of the first plate member 210, the second plate member 220, a first biasing member 230, a second biasing member 240, and a width regulating member 250 in the sheet accommodating device 200 according to the present embodiment. FIG. 8 is a schematic plan view showing examples of the first and second plate members 210 and 220. FIG. 9 is a schematic plan view showing the first plate member 210. FIG. 10 is a schematic plan view showing the second plate member 220. Further, FIG. 11 is a schematic cross-sectional view taken along line XI-XI shown in FIG. 8.

First Embodiment

The sheet accommodating device 200 includes a first plate member 210 (see FIGS. 2 to 9 and 11), a first biasing member 230 (see FIGS. 5 to 7), a second plate member 220 (see FIGS. 2 to 8, 10, and 11), and a second biasing member 240 (see FIGS. 6 and 7). The first plate member 210 is a member on which sheets are mounted. The first biasing member 230 is provided between the first plate member 210 and a bottom member 201*b* (see FIGS. 2 and 3) of a housing 201 (see FIGS. 2 and 3) and presses up the first plate member 210. The second plate member 220 is disposed on a side of the first plate member 210 opposite to a side of the first plate member 210 on which the sheets are mounted. The second biasing member 240 is provided between the second plate member 220 and the bottom member 201*b* of the housing 201 and presses up the second plate member 220. This enables the second biasing member 240 to press up the first plate member 210, which has been pressed up by the first biasing member 230, together with the first biasing member 230. The sheet accommodating device 200 having a configuration in which, according to a size of the sheets, the first biasing member 230 presses up the first plate member 210 or both the first and second biasing members 230 and 240 press up both the first and second plate members 210 and 220. That is, the sheet accommodating device 200 is configured to be switchable between a first upward pressing action and a second upward pressing action according to the size of the sheets. The first upward pressing action is an action by which the first biasing member 230 presses up the first plate member 210. The second upward pressing action is an action by which both the first and second biasing members 230 and 240 press up both the first and second plate members 210 and 220. More specifically, the second upward pressing action is an action by which the second biasing member 240 presses up the second plate member 220 and the second plate member 220 helps press up the first plate member 210 pressed up by the first biasing member 230. Doing so makes it possible to change, according to the size of the sheets, the upward pressing force acting on the first plate member 210. This makes it possible to properly adjust the pressing force acting on the sheet feeding member (or more specifically, a pickup roller 271 [see FIG. 2]). Accordingly, the occurrence of empty feeding or multiple feeding can be prevented regardless of the size of the sheets. In this example, when the size of the sheets is smaller than a predetermined size (in this example, A4 size), the first biasing member 230 presses up the first plate member 210 by the first upward pressing action, and when the size of the sheets is equal to or larger than the predetermined size (in this example, A4 size), both the first and second biasing members 230 and 240 press up both the first and second plate members 210 and 220 by the second upward pressing action.

The first plate member 210 is provided so as to be turnable with respect to the second plate member 220 around a first fulcrum axis line α (see FIG. 4) extending along a width direction H orthogonal to a sheet feed direct on W in which the sheets are fed. The second plate member 220 is provided so as to be turnable with respect to a body (or more specifically, the housing 201) of the sheet accommodating device 200 around a second fulcrum axis line β (see FIG. 4) extending along the width direction H. This makes it only necessary to attach the second plate member 220 to the housing 201 of the sheet accommodating device 200, making it possible to improve assembly workability of the plate members to the housing 201 accordingly.

More specifically, the first plate member 210 turns with respect to the second plate member 220 by means of engagement of projections and depressions. Further, the second plate member 220 turns with respect to the housing 201 by means of engagement of projections and depressions. Specifically, the first plate member 210 has a rear-end notch 210*b* (see FIGS. 4 to 9 and 11) provided in a central part of a rear-end side of the first plate member 210 in the width direction H. Similarly, the second plate member 220 has a rear-end notch 220*b* (see FIGS. 4 to 7, 10, and 11) provided in a central part of a rear-end side of the second plate member 220 in the width direction H. The second plate member 220 has supporting pieces 220*c* (see FIGS. 7 and 10) provided on both sides of the rear-end notch 220*b* in the width direction H and provided with through holes 220*d* (see FIG. 7) bored through the supporting pieces 220*c*, respectively, along the width direction H. The first plate member 210 has support shafts 210*c* (see FIGS. 7 and 9), provided on both outer walls of a rear-end portion of the first plate member 210 in the width direction H, that extend along the inner side of the width direction H. By the support shafts 210*c* being inserted through the through holes 220*d* of the second plate member 220, the first plate member 210 is supported so as to be turnable around the first fulcrum axis line α. The housing 201 has support shafts 201*a* (see FIG. 5), provided on both inner walls of a rear-end portion of the housing 201 in the width direction H, that extend along the inner side of the width direction H. The second plate member 220 has supporting pieces 220*e* (see FIGS. 4 to 8, 10, and 11) provided on both sides of a rear-end portion of the second plate member 220 in the width direction H and provided with through holes 220*f* (see FIGS. 4 to 7) bored through the supporting pieces 220*e*, respectively, along the inner side of the width direction H. By the support shafts 201*a* of the housing 201 being inserted through the through holes 220*f*, the second plate member 220 is supported so as to be turnable around the second fulcrum axis line β.

Incidentally, the first and second plate members 210 and 220 may be coaxially provided; however, in this case, in order for the first plate member 210 to be laid on top of the second plate member 220, the shape of the first plate member 210 as seen from the sheet feed direction W and the shape of the second plate member 220 as seen from the sheet feed direction W (in this example, an L shape) is substantially identical, and to that extent, upsizing of the first plate member 210 is invited. Accordingly, it is desirable to downsize the first plate member 210.

In this regard, the first embodiment is configured such that the first fulcrum axis line α of the first plate member 210 is provided in a position displaced from the second fulcrum axis line β of the second plate member 220. This makes it possible to make a difference between the shape of the first plate member 210 as seen from the sheet feed direction W and the shape of the second plate member 220 as seen from the sheet feed direction W (in this example, an L shape), thereby making it possible to achieve downsizing of the first plate member 210.

The first embodiment is configured such that the first fulcrum axis line α of the first plate member 210 is displaced downward from the second fulcrum axis line β of the second plate member 220. This makes it possible to make the shape of the first plate member 210 as seen from the sheet feed direction W a linear shape in a state where the first plate member 210 is laid on top of the second plate member 220.

The first embodiment is configured such that the first fulcrum axis line α of the first plate member 210 and the second fulcrum axis line β of the second date member 220 overlap in the vertical direction Z (when seen from the vertical direction Z) when the second plate member 220 is located in the lowest position. This makes it possible to reduce an amount of change in relative position of the first and second plate members 210 and 220 that is caused by the second plate member 220 turning when switching between the first and second upward pressing actions takes place.

Incidentally, when the second fulcrum axis line β of the second plate member 220 is located in either the position of a sheet mounting surface 210*a* (see FIGS. 2 to 9 and 11) of the first plate member 210 during the time that both the first and second plate members 210 and 220 are located in the lowest position or a lower position than the sheet mounting surface 210*a* of the first plate member 210, upward turning of the second plate member 220 by the second upward pressing action causes the front end of a sheet that is mounted on the first plate member 210 to draw a trajectory that goes away from a sheet outlet of the housing 201, causing the sheet to travel a longer feed distance accordingly. Accordingly, it is desirable to shorten the feed distance that the sheet travels during the second upward pressing action.

In this regard, the first embodiment is configured such that the second fulcrum axis line β of the second plate member 220 is located in a higher position than the sheet mounting surface 210*a* of the first plate member 210 during the time that both the first and second plate members 210 and 220 are located in the lowest position. In this way, upward turning of the second plate member 220 by the second upward pressing action causes the front end of a sheet that is mounted on the first plate member 210 to draw a trajectory that comes closer to the sheet outlet of the housing 201, thereby making it possible to shorten the feed distance that the sheet travels during the second upward pressing action.

Incidentally, when there is a great difference in level between an upper surface of the first plate member 210 overlapping the second plate member 220 and an upper surface of the second plate member 220, both end portions of the sheet in the width direction H bend to that extent, so that there is high likelihood of inconvenience such as catching of the sheet on a guide (not illustrated) during feeding of the sheet during the second upward pressing action. As for this, especially, in a case where the upper surface of the first plate member 210 is lower than the upper surface of the second plate member 220, both end portions of the sheet in the width direction H bend upward, so that there is high likelihood of inconvenience such as corner buckling (so-called edge buckling). Accordingly, it is desirable to avoid inconvenience such as catching of the sheet on the guide during feeding of the sheet.

In this regard, the first embodiment is configured such that the second plate member 220 is provided with a depressed portion 221 (see FIGS. 4 to 8, 10, and 11) that is depressed downward. The first plate member 210 is set in the depressed portion 221 of the second plate member 220. This makes it possible to minimize or eliminate the difference in level between the upper surface of the first plate member 210 overlapping the second plate member 220 and the upper surface of the second plate member 220. This makes it possible to avoid inconvenience such as catching of the sheet on the guide during feeding of the sheet during the second upward pressing action. This is effective especially in a case where, as shown in FIG. 11, the sheet mounting surface 210*a* of the first plate member 210 overlapping the second plate member 220 is as high as a sheet mounting surface 220*a* (see FIGS. 4 to 8, 10, and 11) of the second plate member 220 or higher by a predetermined amount (e.g. higher by approximately 0.5 mm to 1 mm) than the sheet mounting surface 220*a* of the second plate member 220.

More specifically, the second plate member 220 has its depressed portion 221 formed by downward bending of a region of the second plate member 220 that overlaps the first plate member 210. The depressed portion 221 is provided in a region including at least the sheet mounting surface.

Incidentally, the first biasing member 230 (or more specifically, a pressure spring), which presses up the first plate member 210 by the first upward pressing action, and the second biasing member 240 (or more specifically, a pressure spring), which presses up the second plate member 220 together with the first plate member 210, which has been pressed up by the first biasing member 230, by the second upward pressing action, can be selected in the following manner. That is, prior to selection of the second biasing member 240, a biasing member that has a predetermined upward pressing force during the first upward pressing action is selected as the first biasing member 230. That is, the upward pressing force of the first biasing member 230 during the first upward pressing action is an upward pressing force that serves as a pressing force by which sheets of a maximum accommodatable size (in this example, 16K size) that are mounted on the first plate member 210 during the first upward pressing action are pressed against the pickup roller 271 properly (i.e. to the extent that empty feeding or multiple feeding does not occur) via the first plate member 210 with the sheets mounted on the first plate member 210. Next, a biasing member that has a predetermined upward pressing force during the second upward pressing action is selected as the second plate member 240 in consideration of the upward pressing force of the first biasing member 230 during the first upward pressing action. That is, the upward pressing force of the second biasing member 240 during the second upward pressing action is an upward pressing force that serves as a pressing force that supplements the pressing force of the first biasing member 230 so that sheets of a maximum accommodatable size (i.e. a size that is larger than the maximum accommodatable size that is accommodated during the first upward pressing action; in this example, A4 size or 8½ size) that are mounted on the first plate member 210 during the second upward pressing action are pressed against the pickup roller 271 via the second plate member 220 with the sheets mounted on the first plate member 210.

Accordingly, normally, the upward pressing force of the second biasing member 240 during the second upward pressing action is smaller than the upward pressing force of the first biasing member 230 during the first upward pressing action. This makes it possible not only to properly press the sheets against the pickup roller 271 during the first upward pressing action but also to properly press the sheets against the pickup roller 271 during the second upward pressing action.

It should be noted that the upward pressing force of the second biasing member 240 during the second upward pressing action is smaller than the upward pressing force of the first biasing member 230 by any compression length during the first upward pressing action regardless of compression length. The first biasing member 230 may include a single biasing member or a plurality of biasing members. In this example, the first biasing member 230 includes two first biasing members 230. In the case of a plurality of first biasing members, it is preferable that they all have the same or substantially the same upward pressing characteristics (or more specifically, spring characteristics). This makes it easy to evenly press up the first plate member 210. Similarly, the second biasing member 240 may include a single biasing member or a plurality of biasing members. In this example, the second biasing member 240 includes two first biasing members 240. In the case of a plurality of second biasing members, it is preferable that they all have the same or substantially the same upward pressing characteristics (or more specifically, spring characteristics). This makes it easy to evenly press up the first and second plate members 210 and 220.

More specifically, the second plate member 220 has a front-end notch 220*g* (see FIGS. 7 and 10) provided in a central part of a front-end side of the second plate member 220 in the width direction H. The two first biasing members 230 are disposed to be located within the front-end notch 220*g* below a central part of a front-end side of the first plate member 210 in the width direction H. This enables the two first biasing members 230 to press up the central part of the front-end side of the first plate member 210 in the width direction H. The two second biasing members 240 are disposed to be located below both end portions of the front-end side of the second plate member 220 in the width direction H. This enables the two second biasing members 240 to press up both end portions of the front-end side of the second plate member 220 in the width direction H.

The first embodiment is configured such that the first and second biasing members 230 and 240 are provided side by side so as to be aligned in the width direction H. This makes it possible to stably press the sheets against the pickup roller 271 in a balanced manner during the second upward pressing action.

Specifically, the first and second biasing members 230 and 240 are disposed so that their axial centers are lined up on a virtual straight line along the width direction H. The first and second biasing members 230 and 240 are placed at regular intervals in the width direction H.

The first embodiment is configured such that the sheet accommodating device 200 includes a regulating member (or more specifically, width regulating members and/or a rear-end regulating member; in this example, both the width regulating members and the rear-end regulating member) that regulates a size width of the sheets. Width regulating members 250 (see FIGS. 2 to 7) regulate, in the width direction H, a size width of the sheets in a first direction (width direction H) extending along a sheet surface orthogonal to the sheet feed direction W. A rear-end regulating member 260 (see FIGS. 2 and 3) regulates, in the length direction N, a size width of the sheets in a second direction (length direction N) extending along the sheet feed direction W.

The first and second plate members 210 and 220 are provided with width notches 210*d* (see FIGS. 7 to 9) and width notches 220*h* (see FIGS. 7, 8, and 10), respectively, that allow a movement of the width regulating members 250. The width notches 210*d* are partly-opened depressions. The width notches 220*h* are enclosed holes. The second plate member 220 is provided with extension parts 222 (see FIGS. 4, 8, and 10) extending toward the regulating members, respectively (in this example, outward to the width regulating members 250, respectively, along the width direction H). When regulating the size width of sheets whose size (in this example, 16K size, 7¼ size, B5 size, A5 size, or 5½ size) is smaller than a predetermined size (in this example, A4 size), the regulating members (in this example, the width regulating members 250) constitute a first upward pressing mechanism that is disposed on the extension parts 222 to perform the first upward pressing action (see FIG. 5). When regulating the size width of sheets whose size (in this example, A4 size or 8½ size) is equal to or larger than the predetermined size, the regulating members (in this example, the width regulating members 250) constitute a second upward pressing mechanism that retreats from the extension parts 222 to perform the second upward pressing action (see FIG. 6). This makes it possible, with a simple configuration, to surely switch between the first and second upward pressing actions according to the size of the sheets in tandem with the movement of the regulating members.

More specifically, the width regulating members 250 have insertion holes 251 (see FIGS. 4 to 7) provided, in positions corresponding to the extension parts 222 of the second plate member 220, through which the extension parts 222 are inserted. The insertion holes 251 are bored along the width direction H.

Specifically, the width regulating members 250 are movable along the width direction H and provided on the bottom member 201*b* of the housing 201 so as to be slidable in tandem with each other to one or the other side along the width direction H. The width regulating members 250 have side surfaces, formed so as to extend along the vertical direction Z, that face the sheets. In this example, the width regulating members 250 are provided with sliders 252 (see FIG. 7) that slide width regulating member bodies 250*a* (see FIG. 7) along the width direction H and an interlocking mechanism 253 (see FIG. 7) that causes the width regulating member bodies 250*a* (see FIG. 7) to interlock with each other. The sliders 252 constitute a pair of slide rails 252*a* (see FIG. 7). The slide rails 252*a* are provided at the lower ends of the width regulating member bodies 250*a*, respectively. The slide rails 252*a* extend along the width direction H so that their front-end sides face each other in the length direction N. The interlocking mechanism 253 are constituted by rack gears 253*a* (see FIG. 7) and pinion gears 253*b* (see FIG. 7) that intermesh with the rack gears 253*a*. The slide rails 252*a* have surfaces, opposed to each other, on which the rack gears 253*a* are formed, respectively. The pinion gears 253*b* are axially rotatably fixed to the bottom member 201*b* of the housing 201 while being held between the rack gears 253*a* of the slide rails 252*a*. This makes it possible to slide the width regulating members 250 in tandem with each other to one or the other side along the width direction H.

Incidentally, the area of the first plate member 210 is larger than the area of the second plate member 220. For this reason, the first plate member 210 is normally heavier than the second plate member 220, and it is necessary to use, as the first biasing member 230, which presses up the first plate member 210, a biasing member that has a great upward pressing force accordingly. In general, the first biasing member 230, which presses up the first plate member 210, becomes greater in tolerance as it becomes greater in upward pressing force. This causes deterioration in pressure accuracy of the pressing force of the sheets against the pickup roller 271. Accordingly, it is desirable to improve the pressure accuracy of the pressing force of the sheets against the pickup roller 271. Note here that the areas of the first and second plate members 210 and 220 (areas as seen from a vertical direction) are the projected areas of the first and second plate members 210 and 220 in a horizontal position (areas of shadows formed by irradiation with parallel light from directly above).

In this regard, the first embodiment is configured such that the area of the first plate member 210 is smaller than the area of the second plate member 220 (see FIGS. 9 and 10). This makes it possible to make the first plate member 210 lighter than the second plate member 220 and use, as the first biasing member 230, a biasing member that has a small upward pressing force accordingly. In general, the first biasing member 230 becomes smaller in tolerance as it becomes smaller in upward pressing force. This makes it possible to improve the pressure accuracy of the pressing force of the sheets against the pickup roller 271.

Incidentally, the second plate member 220 is subject to load, as the first plate member 210 is mounted on the second plate member 220 and the sheets are further mounted on the first plate member 210. Accordingly, it is desirable to reduce the weight of the first plate member 210 and improve the strength of the second plate member 220.

In this regard, the first embodiment is configured such that the first plate member 210 is made of a resin material and the second plate member 220 is made of a metal material (or more specifically, a metal plate). This makes it possible to reduce the weight of the first plate member 210 and improve the strength of the second plate member 220.

The first embodiment is configured such that the first plate member 210 is provided so as to be wholly laid on top of the second plate member 220. This makes it possible to surely mount the sheets on the first plate member 210 with its weight further reduced.

The first embodiment is configured such that a dimension L (see FIG. 8) of a predetermined region (i.e. a region upstream by a predetermined distance from the front end in the sheet feed direction W) of the front-end side of the first plate member 210 in the width direction H is equal to or substantially equal to a dimension of a sheet of a maximum accommodatable size (in this example, A4 size or 8½ size) in the width direction H during the second upward pressing action.

This makes it possible to feed the sheet with its front-end portion mounted on a front-end region on a continuous flat surface of the first plate member 210 during both the first and second upward pressing actions. This makes it possible to achieve stably feed the sheet.

Second Embodiment

Figure 12:
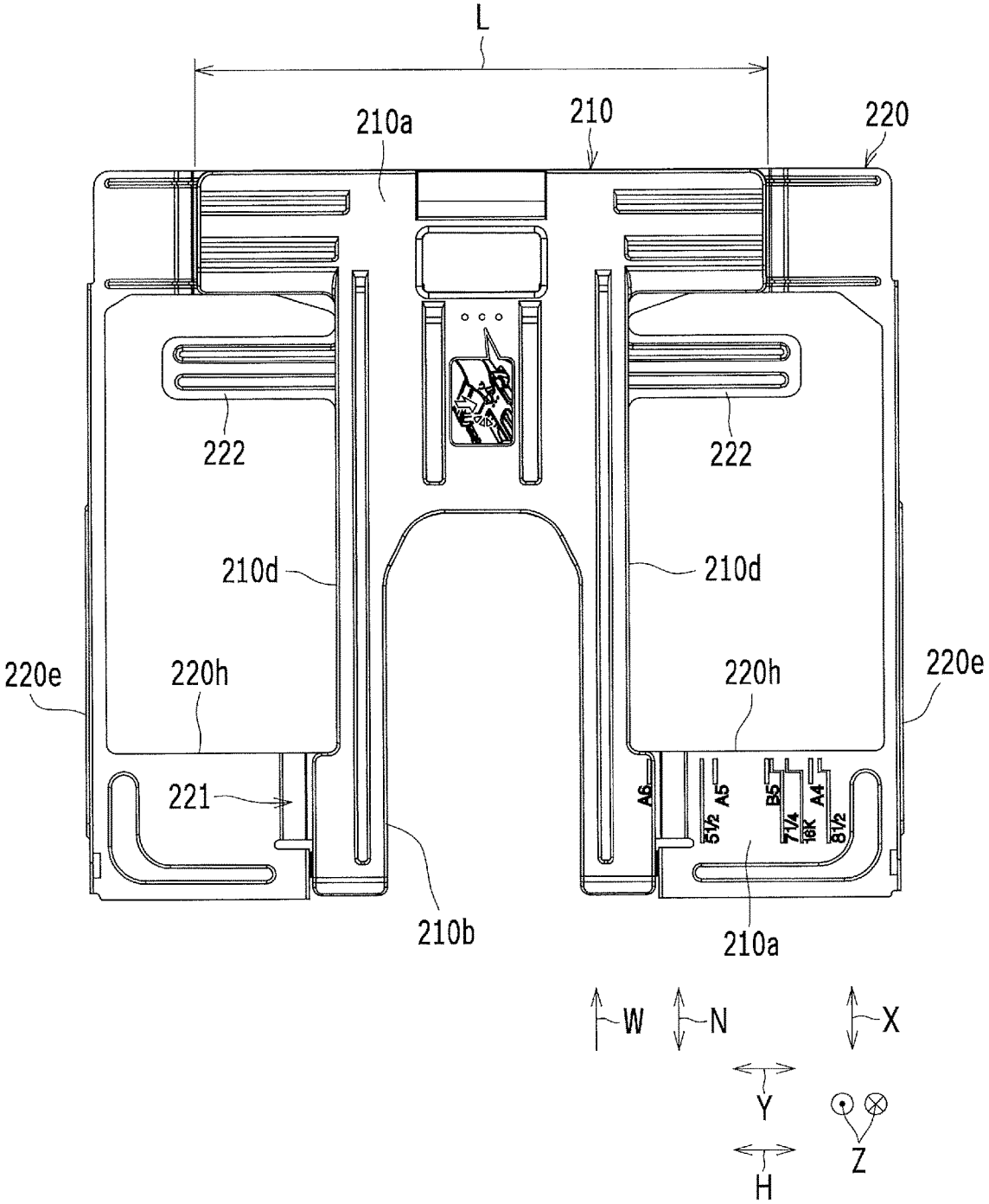
FIG. 12 is a schematic plan view showing other examples of the first and second plate members.
Figure 13:
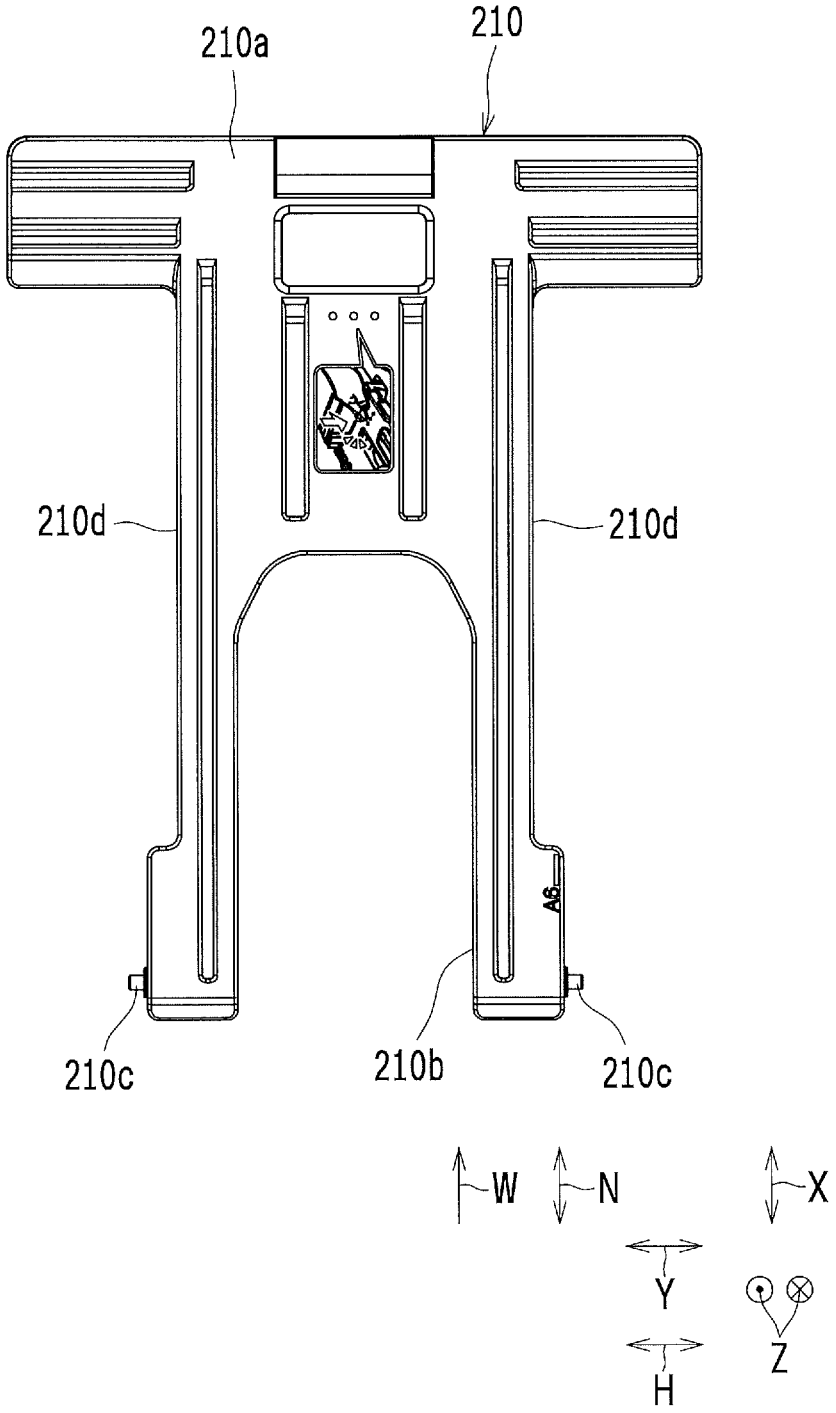
FIG. 13 is a schematic plan view showing the first plate member shown in FIG. 12.
Figure 14:
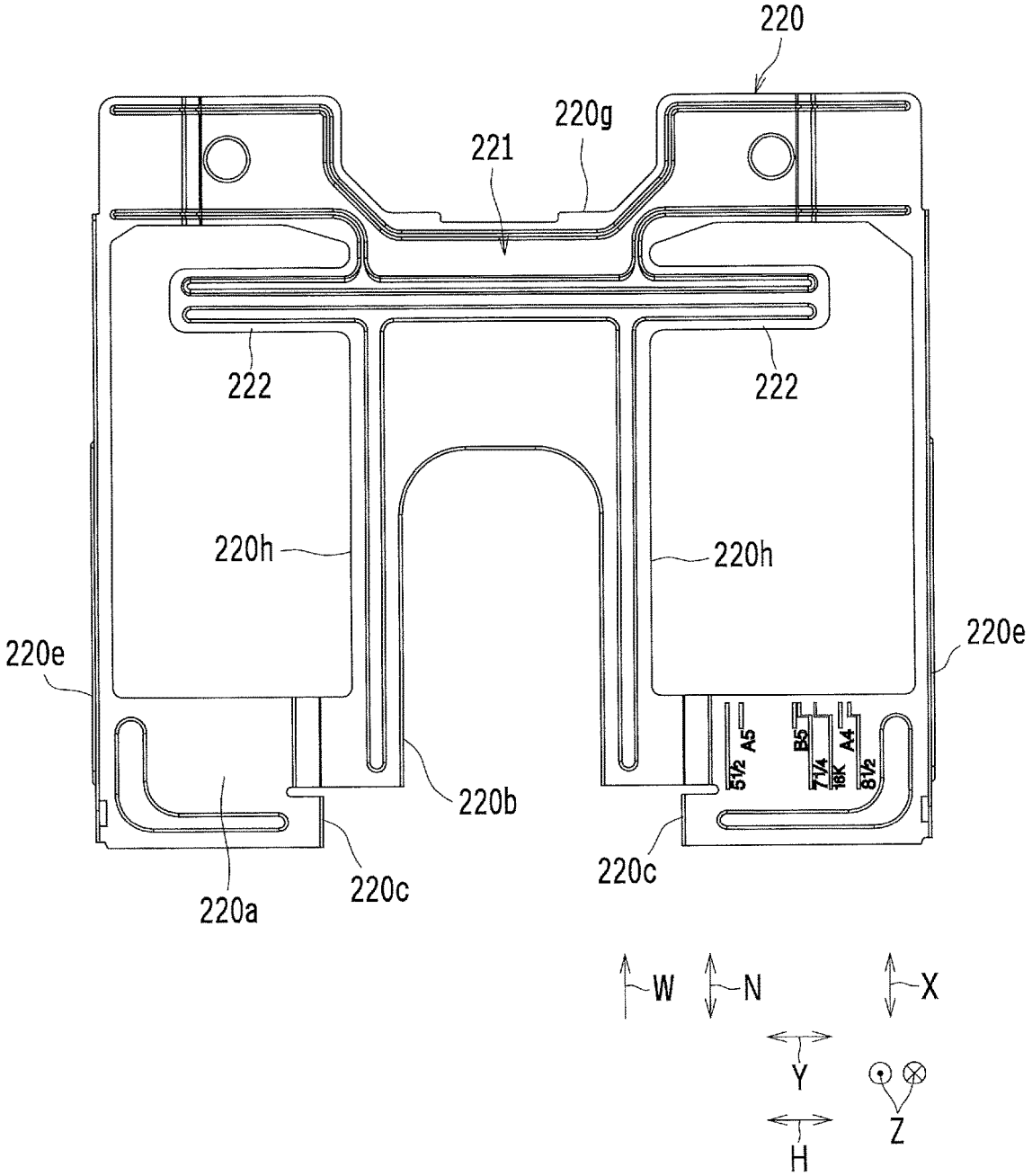
FIG. 14 is a schematic plan view showing the second plate member shown in FIG. 12.

FIG. 12 is a schematic plan view showing other examples of the first and second plate members 210 and 220. FIG. 13 is a schematic plan view showing the first plate member 210 shown in FIG. 12. Further, FIG. 14 is a schematic plan view showing the second plate member 220 shown in FIG. 12.

The dimension L of the predetermined region of the front-end side of the first plate member 210 in the width direction H is not limited to the dimension of the first embodiment, but, as shown in FIG. 12, may be smaller than a dimension of a sheet of a maximum accommodatable size (in this example, A4 size or 8½ size) in the width direction H during the second upward pressing action. The predetermined region of the front-end side of the first plate member 210 is located in the center in the width direction H. For example, the dimension L may be such a dimension (e.g. a dimension of a B5-size sheet in the width direction H) that both end portions of a sheet of a maximum accommodatable size (in this example, 16K size) in the width direction H do not bend downward during the first upward pressing action.

Third Embodiment

Incidentally, if, in a case where the first fulcrum axis line α of the first plate member 210 is located in a lower position than the second fulcrum axis line β of the second plate member 220, the first fulcrum axis line α of the first plate member 210 is provided in a position further away from the front end of a sheet that is mounted on the first plate member 210 than the second fulcrum axis line β of the second plate member 220 in a state where both the first and second plate members 210 and 220 are located in the lowest position, it is necessary to lower the bottom member 201*b* of the housing 201 in order to prevent a portion of the first fulcrum axis line α of the first plate member 210 from coming into contact with the bottom member 201*b* of the housing 201 when the second plate member 220 turns upward, and to that extent, upsizing of the sheet accommodating device 200 is invited. Accordingly, it is desirable not to lower the bottom member 201*b*.

Figure 15:
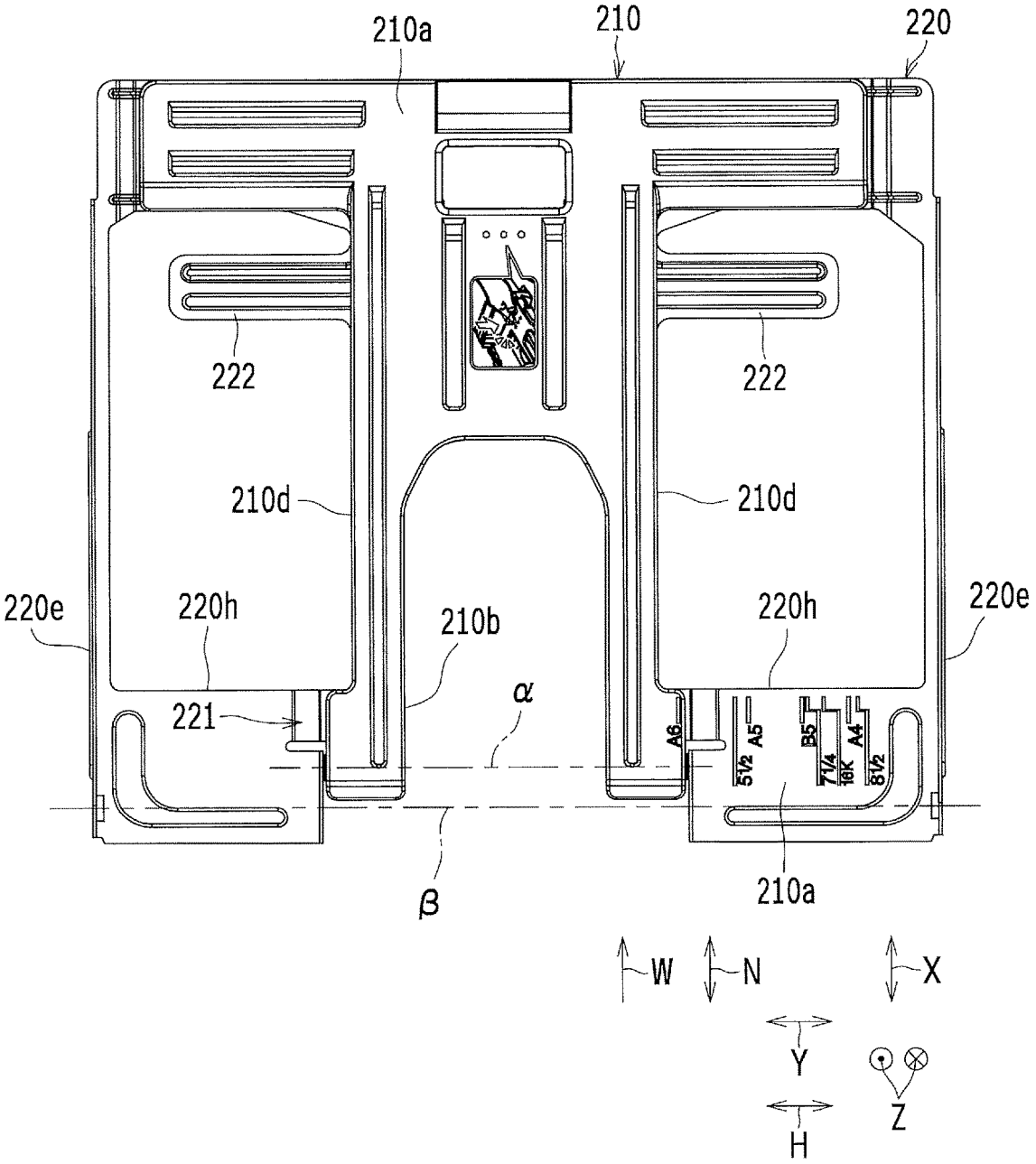
FIG. 15 is a schematic plan view showing still other examples of the first and second plate members.

FIG. 15 is a schematic plan view showing still other examples of the first and second plate members 210 and 220. As shown in FIG. 15, the third embodiment is configured such that the first fulcrum axis line α of the first plate member 210 is provided in a position closer to the front end of a sheet that is mounted on the first plate member 210 than the second fulcrum axis line β of the second plate member 220 in a state where but the first and second plate members 210 and 220 are located in the lowest position. This makes it possible, without having to lower the bottom member 201*b* of the housing 201, to prevent the portion of the first fulcrum axis line α of the first plate member 210 from corning into contact with the bottom member 201*b* of the housing 201 when the second plate member 220 turns upward. This makes it possible to avoid upsizing of the sheet accommodating device 200.

Incidentally, the first biasing member 230 has an upward pressing force by which sheets of a maximum accommodatable size (in this example, 16K size) that are mounted on the first plate member 210 during the first upward pressing action are properly pressed against the pickup roller 271 via the first plate member 210 with the sheets mounted on the first plate member 210. However, when the size of the sheets is too small, the weight of the sheets mounted on the first plate member 210 is too light. Further, depending on the upward pressing characteristics (or specifically, spring characteristics) of the first biasing member 230, the pressing force of the sheets against the pickup roller 271 by the first biasing member 230 is too great. This may make it impossible to press the sheets against the pickup roller 271 properly (i.e. to the extent that multiple feeding does not occur). Accordingly, it is desirable to properly press the sheets against the pickup roller 271 regardless of the size of the sheets.

Figure 16:
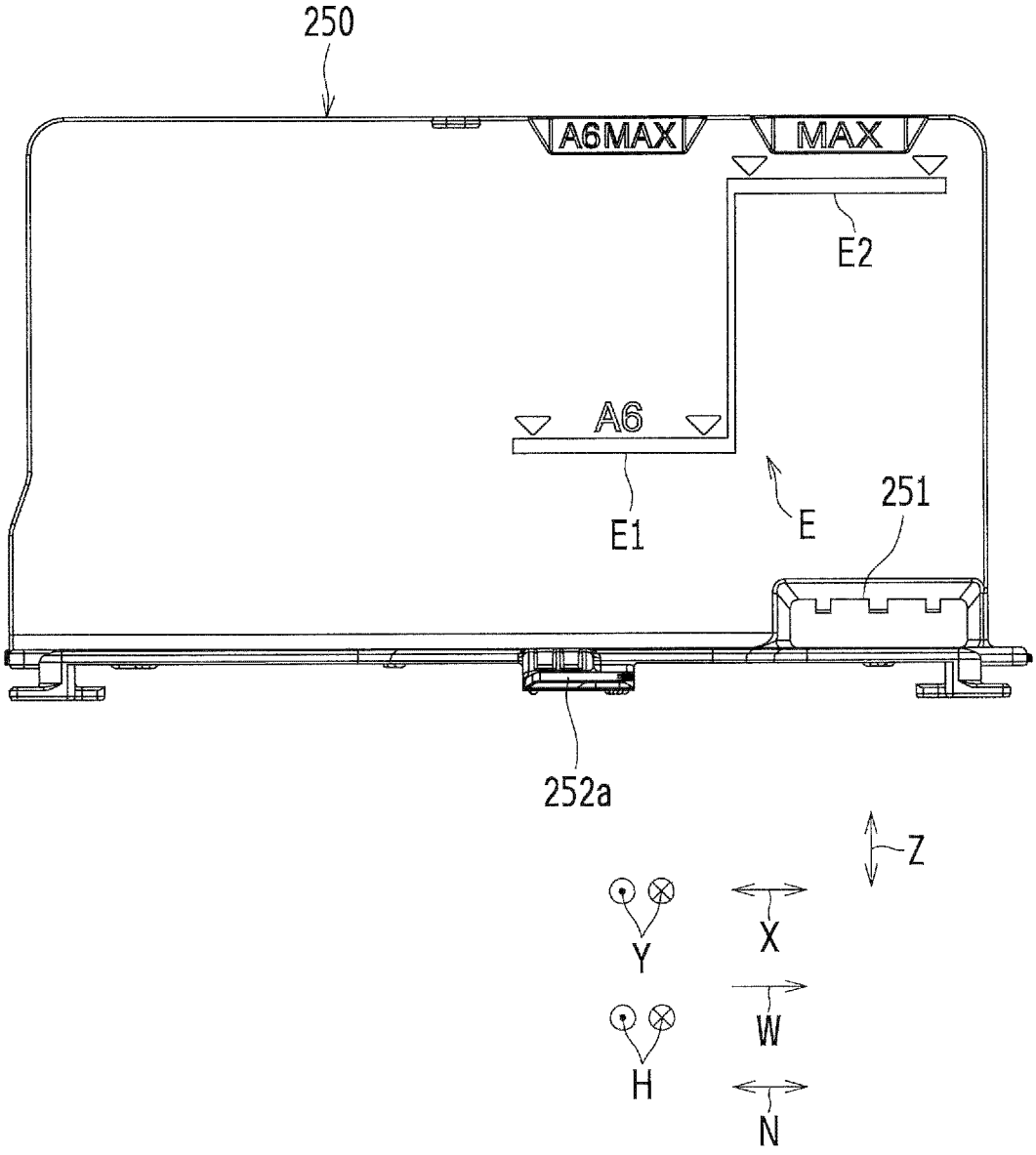
FIG. 16 is a schematic side view of a width regulating member as seen from a sheet mounting side.

FIG. 16 is a schematic side view of a width regulating member 250 as seen from a sheet mounting side. As shown in FIG. 16, the third embodiment is configured such that a side surface of a width regulating member 250 (at least one of the pair of width regulating members 250) that faces the sheet mounting side is provided with a marking E that indicates maximum load capacities respectively corresponding to multiple sizes of sheets. For example, the first biasing member 230 becomes smaller in upward pressing force as a load capacity of sheets (or specifically, an amount of compression) becomes smaller. In this case, a maximum load capacity of sheets of a size (in this example, A6 size, which is the minimum accommodatable size) that is equal to or smaller than a predetermined small size can be made a predetermined load capacity (e.g. such a load capacity that A6-size sheets can be properly pressed against the pickup roller 271) that is smaller than a maximum load capacity (e.g. 500 sheets) of sheets of a size (in this example, a size that is larger than A6 size, which is the minimum accommodatable size) that is larger than the predetermined small size. That is, a first marking E1 (in this example, "A6MAX") that indicates a maximum load capacity (e.g. 200 sheets) of sheets of the size that is equal to or smaller than the predetermined small size is provided in a lower position than a second marking E2 (in this example, "MAX") that indicates a maximum load capacity (e.g. 500 sheets) of sheets of the size that is larger than the predetermined small size. This makes it possible to properly press the sheets against the pickup roller 271 regardless of the size of the sheets.

Figure 17:
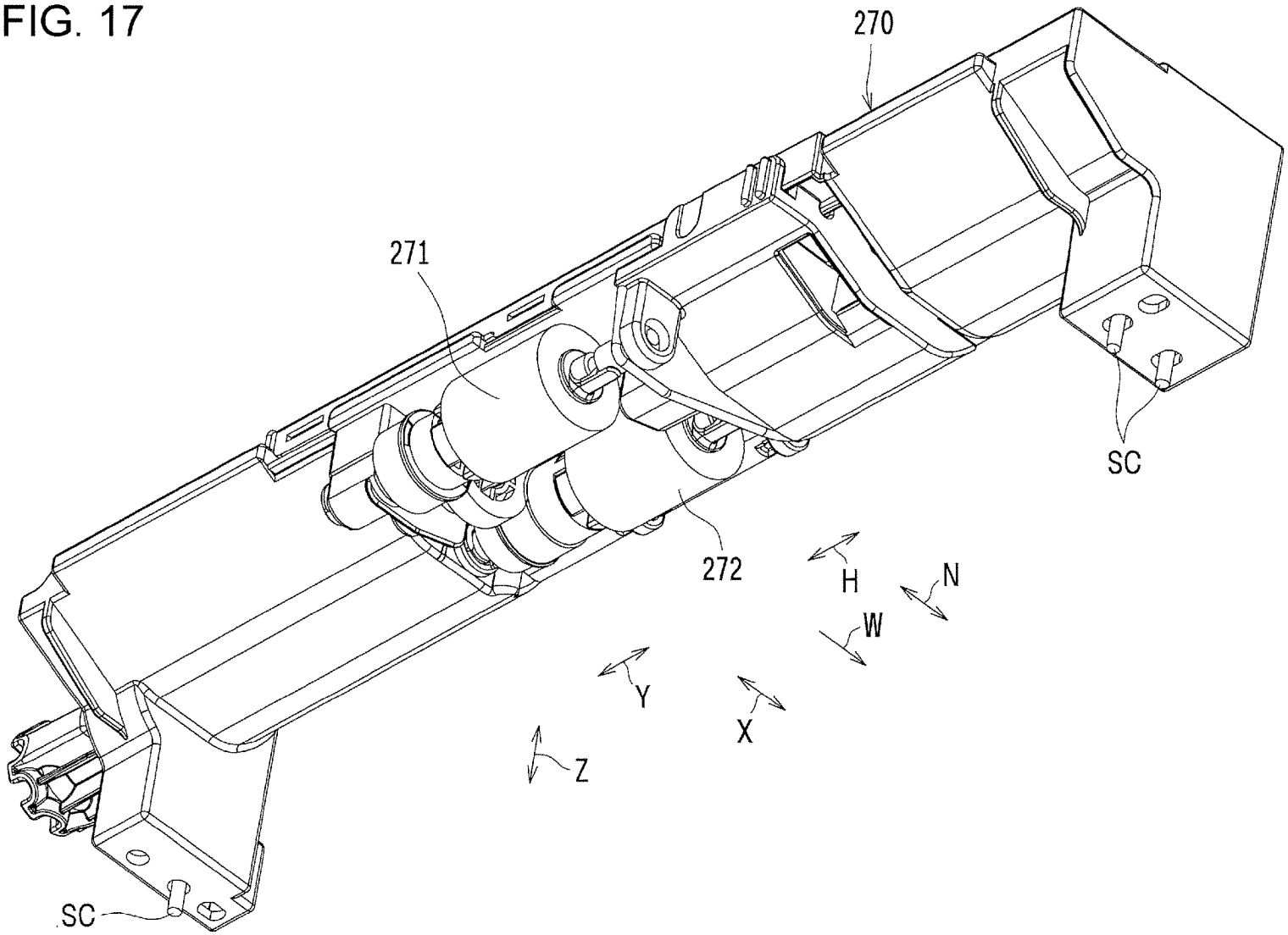
FIG. 17 is a schematic perspective view of the sheet feeding device as seen from obliquely below the front.

FIG. 17 is a schematic perspective view of the sheet feeding device 270 as seen from obliquely below the front. The third embodiment is configured such that the sheet accommodating device 200 includes the sheet feeding device 270 (see FIGS. 2 and 17) having the pickup roller 271 that feeds sheets one by one. Moreover, the sheet feeding device 270 is provided in the housing 201. This makes it possible to achieve compactification of the sheet accommodating device 200 including the sheet feeding device 270.

More specifically, the sheet feeding device 270 includes a sheet conveying member (or specifically, a sheet conveying roller 272) in addition to the pickup roller 271. Together with a separating member 280 (see FIG. 3) (or specifically, a separating roller), the sheet conveying roller 272 causes sheets pulled out by the pickup roller 271 to be fed one by one to the image forming apparatus body 110. The separating member 280 is provided in the housing 201. Moreover, the sheet feeding device 270 is fixed to the housing 201 by fixing members SC (see FIG. 17) such as screws (see FIG. 2). It should be noted that the configuration of the pickup roller 271, the sheet conveying roller 272, and the separating member 280 is similar to a conventionally publicly-known configuration and, as such, is not described in detail here.

Moreover, the sheet accommodating device 200 is provided in the image forming apparatus body 110 so as to be freely attached to and detached from the image forming apparatus body 110 by being slid along the width direction H.

OTHER EMBODIMENTS

The present embodiment is configured such that the first plate member 210 is made of a resin material and the second plate member 220 is made of a metal material. Alternatively, the first plate member 210 may be made of a metal material, and the second plate member 220 may be made of a resin material. Further, both the first and second plate members 210 and 220 may be made of a metal material or a resin material. Further, although the present embodiment is configured such that each of the first and second biasing members 230 and 240 includes a plurality of biasing members, each of the first and second biasing members 240 may alternatively include a single biasing member. In this case, the first and second biasing members 230 and 240 can be provided side by side along the length direction N. Further, although the present embodiment is configured such that the regulating member includes the width regulating members 250, the regulating member may alternatively or additionally include the rear-end regulating member 260.

The present disclosure is not limited to the embodiments described above but may be carried out in other various forms. Therefore, the embodiments are mere examples in all respects and should not be interpreted in a limited way. The scope of the present disclosure is indicated by the scope of the claims and is not bound in any way by the body of the specification. Furthermore, all modifications and alternations belonging to the equivalents of the scope of the claims are encompassed in the scope of the present disclosure.

The present disclosure contains subject matter related to that disclosed in Japanese Priority Patent Application JP 2017-212001 filed in the Japan Patent Office on Nov. 1, 2017, the entire contents of which are hereby incorporated by reference.

What is claimed is:

1. A sheet accommodating device comprising:

a first plate member on which sheets are mounted;

a first biasing member that presses up the first plate member;

a second plate member disposed on a side of the first plate member opposite to a side of the first plate member on which the sheets are mounted; and a second biasing member that presses up the second plate member, the sheet accommodating device having a configuration in which, according to a size of the sheets, the first biasing member presses up the first plate member or both the first and second biasing members press up both the first and second plate members, wherein an area of the first plate member is smaller than an area of the second plate member.

2. The sheet accommodating device according to claim 1, wherein the first plate member is made of a resin material and the second plate member is made of a metal material.

3. The sheet accommodating device according to claim 1, wherein the first plate member is provided so as to be wholly laid on top of the second plate member.

4. The sheet accommodating device according to claim 1, wherein the first plate member is provided so as to be turnable with respect to the second plate member around a first fulcrum axis line extending along a width direction orthogonal to a sheet feed direction in which the sheets are fed, and the second plate member is provided so as to be turnable with respect to a body of the sheet accommodating device around a second fulcrum axis line extending along the width direction.

5. The sheet accommodating device according to claim 1, further comprising a sheet feeding device having a sheet feeding member that feeds the sheets one by one, wherein the sheet feeding device is provided in the body of the sheet accommodating device.

6. An image forming apparatus comprising the sheet accommodating device according to claim 1.

* * * * *